US009488179B2

(12) United States Patent
Perrot et al.

(10) Patent No.: US 9,488,179 B2
(45) Date of Patent: Nov. 8, 2016

(54) COMPRESSOR AND A TURBINE ENGINE WITH OPTIMIZED EFFICIENCY

(75) Inventors: Vincent Paul Gabriel Perrot, Maisons Alfort (FR); Agnes Pesteil, Alfortville (FR); Lieven Baert, Etterbeek (BE); Vasiliki Iliopoulou, Ixelles (BE)

(73) Assignee: SNECMA, Paris (FR)

( * ) Notice: Subject to any disclaimer, the term of this patent is extended or adjusted under 35 U.S.C. 154(b) by 829 days.

(21) Appl. No.: 13/703,809

(22) PCT Filed: Jun. 9, 2011

(86) PCT No.: PCT/FR2011/051307

§ 371 (c)(1),
(2), (4) Date: Feb. 21, 2013

(87) PCT Pub. No.: WO2011/157927

PCT Pub. Date: Dec. 22, 2011

(65) Prior Publication Data

US 2013/0156559 A1 Jun. 20, 2013

(30) Foreign Application Priority Data

Jun. 17, 2010 (FR) ..... 10 54826

(51) Int. Cl.
*F04D 29/00* (2006.01)
*F04D 19/00* (2006.01)
(Continued)

(52) U.S. Cl.
CPC ..... *F04D 19/00* (2013.01); *F01D 5/143* (2013.01); *F01D 5/145* (2013.01); *F01D 5/20* (2013.01);
(Continued)

(58) Field of Classification Search
CPC .. F04D 29/526; F04D 29/546; F04D 29/547; F04D 29/68; F01D 11/08; F01D 5/143
See application file for complete search history.

(56) References Cited

U.S. PATENT DOCUMENTS 4,086,022 A * 4/1978 Freeman et al. ..... 415/119
5,513,952 A 5/1996 Mizuta et al.
(Continued)

FOREIGN PATENT DOCUMENTS

CN 1251153 A 4/2000
CN 1281953 A 1/2001
(Continued)

OTHER PUBLICATIONS

International Search Report Issued Aug. 26, 2011 in PCT/FR11/51307 Filed Jun. 9, 2011.
(Continued)

*Primary Examiner* — Charles Freay
*Assistant Examiner* — Christopher Bobish
(74) *Attorney, Agent, or Firm* — Oblon, McClelland, Maier & Neustadt, L.L.P.

(57) ABSTRACT

A turbine engine compressor including a casing having its inside wall defining an aerodynamic reference surface for a gas-passing passage and in which a rotor wheel having radial blades is mounted. A circumferential trench is formed in the inside wall of the casing. Its shape is defined from upstream to downstream by three surfaces, respectively an upstream surface, a middle surface, and a downstream surface, which surfaces are substantially conical. The upstream surface extends upstream from the leading edges of the blades. The middle surface is substantially parallel to the aerodynamic reference surface. The downstream surface extends downstream at least as far as the trailing edges of the blades. The junction between the middle and downstream surfaces is in a range of 30% to 80% or 50% to 65% of the axial length of the blades starting from their leading edges.

16 Claims, 4 Drawing Sheets

(51) Int. Cl.

| | |
|---|---|
| ***F04D 29/54*** | (2006.01) |
| ***F04D 29/68*** | (2006.01) |
| ***F01D 5/14*** | (2006.01) |
| ***F01D 5/20*** | (2006.01) |
| ***F04D 29/52*** | (2006.01) |

(52) U.S. Cl.

CPC ..... *F04D 29/522* (2013.01); *F04D 29/526* (2013.01); *F04D 29/545* (2013.01); *F04D 29/547* (2013.01); *F04D 29/68* (2013.01); *F04D 29/681* (2013.01); *F05D 2250/232* (2013.01); *F05D 2250/314* (2013.01); *F05D 2260/2212* (2013.01)

(56) References Cited

U.S. PATENT DOCUMENTS

| | | | | |
|---|---|---|---|---|
| 6,338,609 | B1 | 1/2002 | Decker et al. | |
| 6,499,940 | B2 * | 12/2002 | Adams | 415/9 |
| 8,177,494 | B2 * | 5/2012 | Ward et al. | 415/173.4 |
| 2004/0028526 | A1 | 2/2004 | Teramura et al. | |
| 2005/0141990 | A1 | 6/2005 | Guemmer | |
| 2010/0098536 | A1 | 4/2010 | Guemmer | |
| 2011/0058931 | A1 | 3/2011 | Domercq et al. | |
| 2011/0085896 | A1 * | 4/2011 | Brunet et al. | 415/182.1 |
| 2011/0110773 | A1 | 5/2011 | Domercq et al. | |

FOREIGN PATENT DOCUMENTS

| | | | | |
|---|---|---|---|---|
| CN | 1646790 | A | 7/2005 | |
| CN | 1800589 | A | 7/2006 | |
| EP | 0 675 290 | | 10/1995 | |
| EP | 1 126 133 | | 8/2001 | |
| EP | 1 536 147 | | 6/2005 | |
| EP | 2 180 195 | | 4/2010 | |
| EP | 2218918 | A1 * | 8/2010 | F04D 29/54 |
| FR | 2 247 630 | A1 | 6/1975 | |
| GB | 10179 | * | 6/1912 | |
| GB | 1071865 | A | 6/1967 | |

OTHER PUBLICATIONS

Combined Chinese Office Action and Search Report issued Feb. 4, 2015 in Patent Application No. 2011800299821 (with English language translation).

* cited by examiner

COMPRESSOR AND A TURBINE ENGINE WITH OPTIMIZED EFFICIENCY

The invention relates to axial flow compressors for a turbine engine.

Such compressors generally comprise a casing in which a rotor wheel is rotatably mounted, the wheel having a set of radial blades, each having a tip, a leading edge, and a trailing edge. In general, the blades are arranged in such a manner that their tips pass as close as possible to the inside wall of the casing.

Nevertheless, it is necessary to leave clearance between the blade tips and the inside wall of the casing. Thus, when the wheel is rotating relative to the casing, air (or more generally fluid) flows from its pressure sides to its suction sides through the clearance between the blades and the casing. This flow is very turbulent. It therefore generates vortices referred to as "clearance" vortices that give rise to losses of efficiency for the compressor, with this effect increasing with increasing interaction between the clearance vortices and the boundary layers that exist on the casing wall.

In order to reduce the magnitude of the clearance vortices, it is known to provide a trench in the inside wall of the casing, substantially in register with the blade tips. This trench is an axially symmetrical groove formed in the wall of the casing. The trench is set back from the aerodynamic reference surface, i.e. the shape that the inside wall of the casing would have if it did not have a trench and that corresponds to the general shape of the passage for passing gas.

Patent GB 10179 filed on Apr. 30, 1912 gives an example of a compressor including such a trench. In the compressor disclosed in that patent, the trench is formed essentially by three substantially conical surfaces, namely an upstream surface, a middle surface, and a downstream surface, which surfaces extend one after another from upstream to downstream. The middle surface is substantially parallel to the aerodynamic reference surface. The downstream surface joins the aerodynamic reference surface immediately downstream from the trailing edges of the blades.

The advantage of such a trench is that, by virtue of its middle surface extending parallel to the aerodynamic reference surface, it makes it possible to generate a clearance vortex that is relatively limited. The gas passing between the blade and the middle surface of the casing does not pass within the aerodynamic reference surface but rather in a position that is offset towards the bottom of the trench and that is thus radially remote from the normal gas-passing passage defined by the aerodynamic reference surface. Because of this offset, the amount of fluid passing from the pressure sides to the suction sides past the middle surface is relatively small and contributes very little to clearance vortices.

Nevertheless, at the upstream and downstream ends of the trench, fluid passes in highly turbulent manner and contributes significantly to clearance vortices.

It follows that the trench in the compressor enables the efficiency of the compressor to be improved, but only to a small extent, and furthermore does not provide any improvement in terms of pumping margin, and possibly even degrades it.

Other examples of compressors in which the casing presents a special arrangement are disclosed in document EP 2 180 195.

Thus, the object of the invention is to propose an axial flow turbine engine compressor comprising:

a casing presenting an inside wall of general shape that defines an aerodynamic reference surface defining a gas-passing passage;

a rotor wheel mounted to rotate relative to the casing in said passage;

the wheel carrying a plurality of radial blades, each having a tip, a leading edge, and a trailing edge;

a circumferential trench being formed in the inside wall of the casing;

the shape of said trench being defined essentially by three substantially conical surfaces, namely an upstream surface, a middle surface, and a downstream surface, the surfaces following one after another from upstream to downstream;

the middle surface being substantially parallel to said aerodynamic reference surface; and the downstream surface extending downstream at least as far as the trailing edges of the blades;

in which compressor the losses of efficiency due to clearance vortices are reduced, but the pumping margin is at least as good as in previously known compressors.

The aerodynamic reference surface is not physically embodied, and it has the shape that the casing would have if the trench had not been formed in the wall of the casing.

The above-mentioned object is achieved by the fact that in the compressor, the upstream surface extends upstream from the leading edges of the blades; and the junction between the middle and downstream surfaces is situated in the range 30% to 80% and preferably in the range 50% to 65% of the axial length of the blades starting from the leading edge.

The invention thus consists in joint arrangement of the casing and of the shape of the blade tips enabling the clearance flow to take place not within the aerodynamic reference surface, but in a trench that is formed in the casing wall.

The trench presents a novel shape with three slopes. These three slopes comprise three surfaces each having its own specific function:

The middle surface is the surface that serves to maintain a significant pressure difference between the pressure side and the suction side of each of the blades. Since the middle surface defines the longest portion of the blade, it is the surface that is best placed for limiting the stream passing from the pressure side to the suction side, given that it is offset outside the aerodynamic reference surface: also, the path followed by the fluid in order to go from the pressure side to the suction side is at its longest where it is in register with the middle surface, or in other words that is where the radial detour imposed on the stream is the greatest. That is why, the greater the middle surface, the smaller the stream of fluid passing from the pressure side to the suction side and thus the greater the efficiency of the rotor wheel, ignoring edge effects.

Following this reasoning, it might be desired to increase the size of the middle surface as much as possible. That has been done in numerous prior embodiments. Nevertheless, such an approach is not optimum since the above-mentioned improvement in efficiency is reduced as a result of edge effects, i.e. an increase in the generation of vortices by the sharp upstream and downstream edges of the trench.

In the invention, the upstream and downstream surfaces also have the function of minimizing the formation of vortices on entry to and on exit from the trench, and they are shaped in such a manner as to perform that vortex-minimizing function.

For this purpose, the upstream surface is located entirely upstream from the leading edges of the blades. This enables the middle surface to extend as far as possible upstream, i.e. as far as the leading edges of the blades.

Nevertheless, it is not possible to proceed in the same manner for the downstream portion of the trench; in order to reduce the magnitude of the vortices generated at the trailing edges of the blades, it is preferable to limit the extent of the trench in the downstream direction. The invention thus defines an optimized solution that consists in interrupting the middle surface in the range 30% to 80% relative to the chord of the blades, and to arrange the downstream surface with a shallow slope enabling the middle surface of the trench to rejoin the main surface of the casing gently (i.e. to rejoin the aerodynamic reference surface gently).

By means of these provisions, the compressor of the invention presents better efficiency than a conventional compressor. Compared with prior art compressors, the compressor of the invention provides better results in terms of efficiency and in terms of pumping margin. In particular, the change of slope between the middle and downstream surfaces formed in the range 30% to 80% of the axial length of the blades achieves better interaction between the clearance flow and the main flow. The downstream surface presents a shallow slope that is a poor generator of vortices.

Advantageously, because the upstream surface is offset upstream from the leading edges of the blades, providing the downstream surface with a shallow slope does not give rise to an excessive reduction in the size of the middle surface. By means of the invention, the middle surface is conserved over a size that is significant (30% to 80% of the actual length of the blade), thereby enabling it to be highly effective concerning the efficiency of the compressor.

In addition, and advantageously, the arrangements provided in the trench and the blades by means of the invention present no special difficulty during fabrication of the casing or the blades.

The term "the shape of said trench being defined essentially by three surfaces . . . " is associated with the fact that small connection or junction surfaces of the connecting fillet type are usually provided for connecting together the upstream surface with the middle surface and the middle surface with the downstream surface. Such junction surfaces are also generally provided between the upstream surface and the aerodynamic reference surface upstream from the trench and between the downstream surface and the aerodynamic reference surface downstream from the trench.

In an embodiment, the upstream surface extends upstream from the leading edges of the blades in the range 5% to 25% and preferably in the range 7% to 20% of the inter-blade pitch between the tips of two consecutive blades in the circumferential direction.

A relatively large extent in the upstream direction (more than 5% of the inter-blade pitch) for the upstream surface is preferable to an upstream surface that is straight, i.e. in the form of a step. If the upstream surface is compact and forms a staircase step in the vicinity of the leading edges of the blades, then, when the moving fluid encounters the step it, forms a vortex which propagates and subsequently mixes with the clearance vortex: this leads to significant losses of efficiency.

In an embodiment, the downstream surface extends downstream from the trailing edges of the blades in the range 5% to 25% and preferably 7% to 20% of the inter-blade pitch between the tips of two consecutive blades in the circumferential direction.

A relatively large extent in the downstream direction (more than 5% of the inter-blade pitch) for the downstream surface is preferable to a downstream surface that is straight, i.e. in the form of a step. If the downstream surface is compact and forms a staircase step in the vicinity of the trailing edges of the blades, fluid stagnates in the corner formed in that way by the trench and heats up as a result of the blades moving past, thereby creating losses in the clearance zone that are in addition to those generated by the vortex that is directly created by the step.

In an embodiment, in longitudinal section, the downstream surface forms an angle of less than 15°, and preferably of less than 5°, with the aerodynamic reference surface.

In an embodiment, in longitudinal section, the upstream surface forms an angle of less than 90°, and preferably of less than 30°, with the aerodynamic reference surface.

In both of the above embodiments, the fact of forming upstream and/or downstream surfaces that are shallow in slope at angles that are relatively small serves to minimize the generation of vortices and thus to minimize the loss of efficiency at the upstream and downstream ends of the trench.

In an embodiment, the blades extend inside or as far as the aerodynamic reference surface, without penetrating into the inside of the trench. It is desirable to minimize the disturbance to the stream that occurs as the rotor wheel goes past; it is also desirable for the fluid path to remain contained as much as possible within the aerodynamic reference surface between the blades. It therefore appears to be undesirable for the blades to extend into the casing, i.e. to project beyond the aerodynamic reference surface. Nevertheless, an embodiment with blades that are longer and that penetrate into the inside of the trench could also be envisaged.

In an embodiment, substantially constant radial clearance extends between the tips of the blades and the trench. This clearance may be equal to the clearance usually provided between the blade tips and the casing for passages that are smooth, i.e. that do not include trenches.

A second object of the invention is to propose a turbine engine including at least one compressor, in which turbine engine the losses of efficiency due to clearance vortices in the compressor are reduced, but the pumping margin is at least as good as in engines including previously known compressors.

This object is achieved by the fact that the compressor is a compressor as defined above.

The invention can be well understood and its advantages appear better on reading the following detailed description of embodiments shown as non-limiting examples. The description refers to the accompanying drawings, in which.

Figure 1:
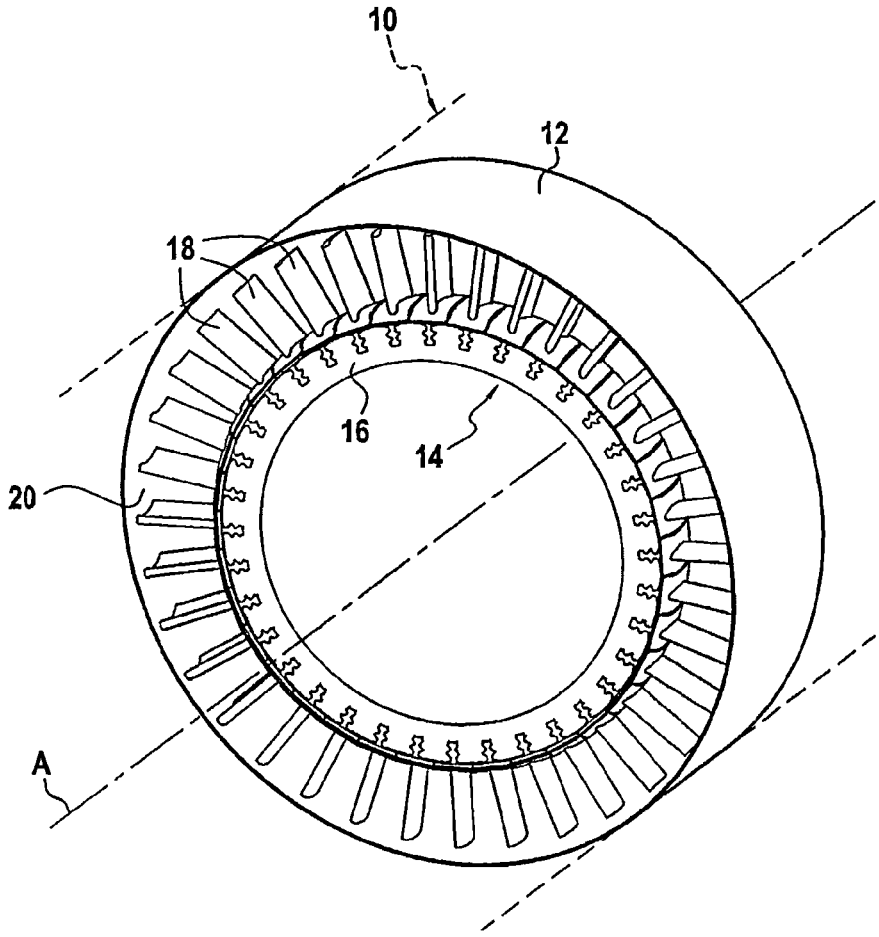
FIG. 1 is a diagrammatic view of a portion of a compressor.

FIG. 1 shows an axial flow compressor of a turbine engine 10. The compressor has a casing 12 with a rotor wheel 14 mounted therein. The rotor wheel 14 itself comprises a rotor disk 16 having radial blades 18 fastened thereto in known manner in an axially symmetrical configuration. The rotor wheel is arranged to be capable of rotating about an axis of rotation A inside the casing 12.

The casing 12 presents an inside wall 20 of general shape that defines an aerodynamic reference surface 22 (FIG. 3) defining a passage through which gas can pass. This aerodynamic reference surface is a surface of revolution, of general shape that is substantially conical, and in the present example that is cylindrical.

The arrangement of the blades 18 and of the inside wall 20 of the compressor 10 in the invention for reducing clearance vortices, is described with reference to FIG. 3.

Figure 3:
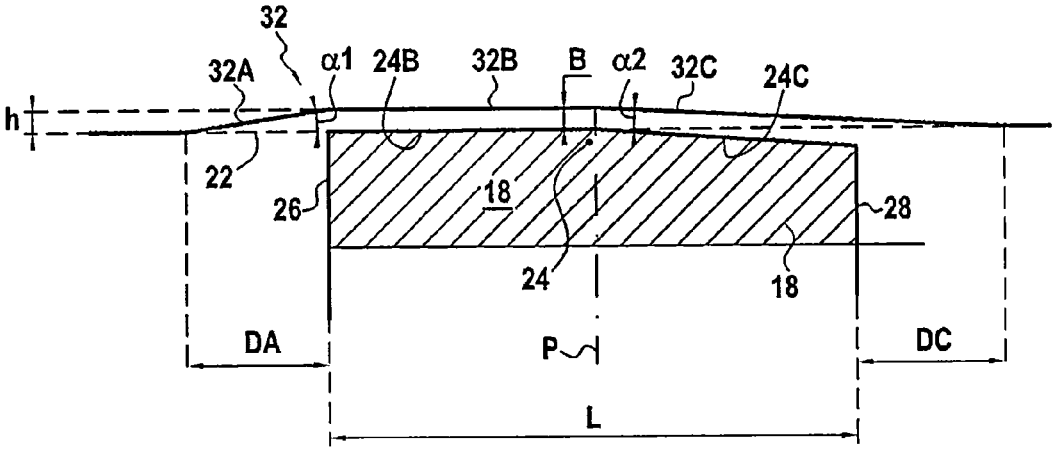
FIG. 3 is a diagrammatic axial section view of a compressor portion on a plane containing a blade.

As shown in FIG. 3, each blade 18 has a leading edge 26, a trailing edge 28, and a radially outer tip 24 that extends axially over a distance L from its upstream end to its downstream end. Naturally, a small amount of clearance B is provided between the tip 24 of the blade 18 and the inside wall 20 of the casing 12 (which clearance may in certain circumstances be modified as a result of friction that takes place during the initial hours of operation of the engine).

Figure 2:
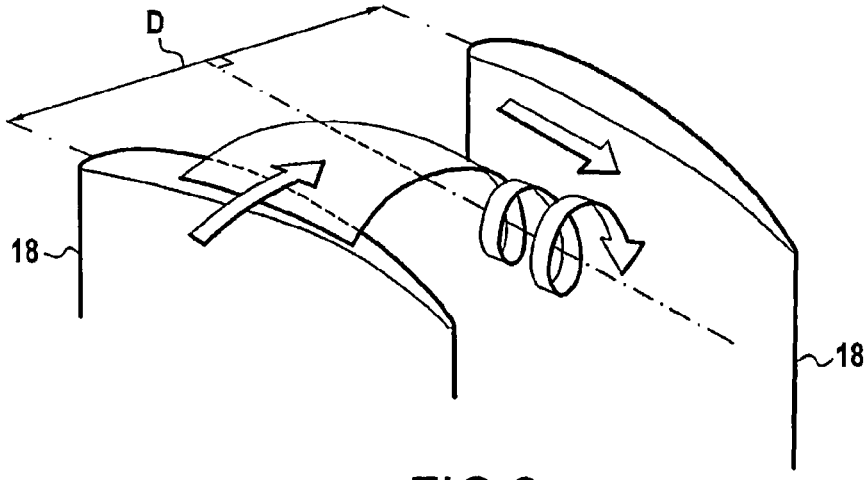
FIG. 2 is a diagrammatic perspective view showing the clearance vortex.

Furthermore, as shown in FIG. 2, the ends of the blades are spaced apart from one another in pairs by a distance D in the circumferential direction, referred to as the inter-blade direction.

In order to reduce clearance vortices, a circumferential trench 32 is formed in the inside wall 20 of the casing 12. This trench is made up of three substantially conical surfaces, namely an upstream surface 32A, a middle surface 32B, and a downstream surface 32C. These three surfaces extend one after another going from upstream to downstream (from left to right in FIG. 3).

In the most common circumstance (as shown), going from upstream to downstream, the upstream surface is of increasing diameter, the middle surface is of substantially constant diameter, and the downstream surface is of decreasing diameter.

The tip 24 of the blade 18 is arranged so as to maintain clearance B relative to the trench that is substantially constant.

For this purpose, at its upstream end, the tip 24 of the blade presents an upstream portion 24B facing the middle surface 32B that coincides locally with the aerodynamic reference surface 22. Further downstream, where it faces the downstream surface 32C (and more precisely an upstream portion of the downstream surface) the tip 24 of the blade presents a downstream portion 24C. In the embodiment shown, the downstream portion 24C is formed (like the upstream portion 24B) so as to maintain constant clearance between the tip 24 of the blade and the trench 32. Thus, the portion 24C of the blade is pared away or radially shortened a little relative to the upstream portion 24B.

The upstream surface 32A extends upstream from the leading edges of the blades over a distance DA that is about 10% of the inter-blade pitch. The angle $\alpha 1$ formed by the upstream surface 32A in an axial section relative to the aerodynamic reference surface 22 is about 15°.

The middle surface 32B is a surface that is substantially parallel to the aerodynamic reference surface 22 (it can be said to be "offset" relative thereto). In other words, and more precisely, in an axial (or meridian) section such as that of FIG. 3, the curve followed by the section of the surface 24B is parallel to the curve followed by the section of the aerodynamic reference surface 22.

The middle surface 32B extends from the leading edge of the blade 18 to a plane P situated at 50% of the distance L from the leading edge 26 of the blade 18.

The downstream surface 32C extends downstream from the middle surface 32B at least as far as the trailing edge 28, and preferably beyond it to a distance DC downstream from the trailing edge 28. In the example shown in FIG. 3, the downstream surface 32C extends over a distance DC that is equal to about 10% of the inter-blade pitch D. Thus, the angle $\alpha 2$ formed by the downstream surface 32C in an axial section relative to the aerodynamic reference surface 22 is about 1°.

The contribution of the invention for reducing the clearance vortex phenomenon is described in detail below with references to FIGS. 4 and 5.

When the rotor wheel 14 is rotating relative to the casing 12 about the axis A, the tips 24 of the blades 18 move at high speed past the inside wall 20 of the casing 12.

Under the effect of this rotation, a pressure difference is established between the pressure side and the suction side of each blade 18. As a result, a small stream of fluid (air) passes through the clearance B between the blade tips and the bottom of the trench. This stream generates a strong vortex referred to as the clearance vortex.

Figure 4:
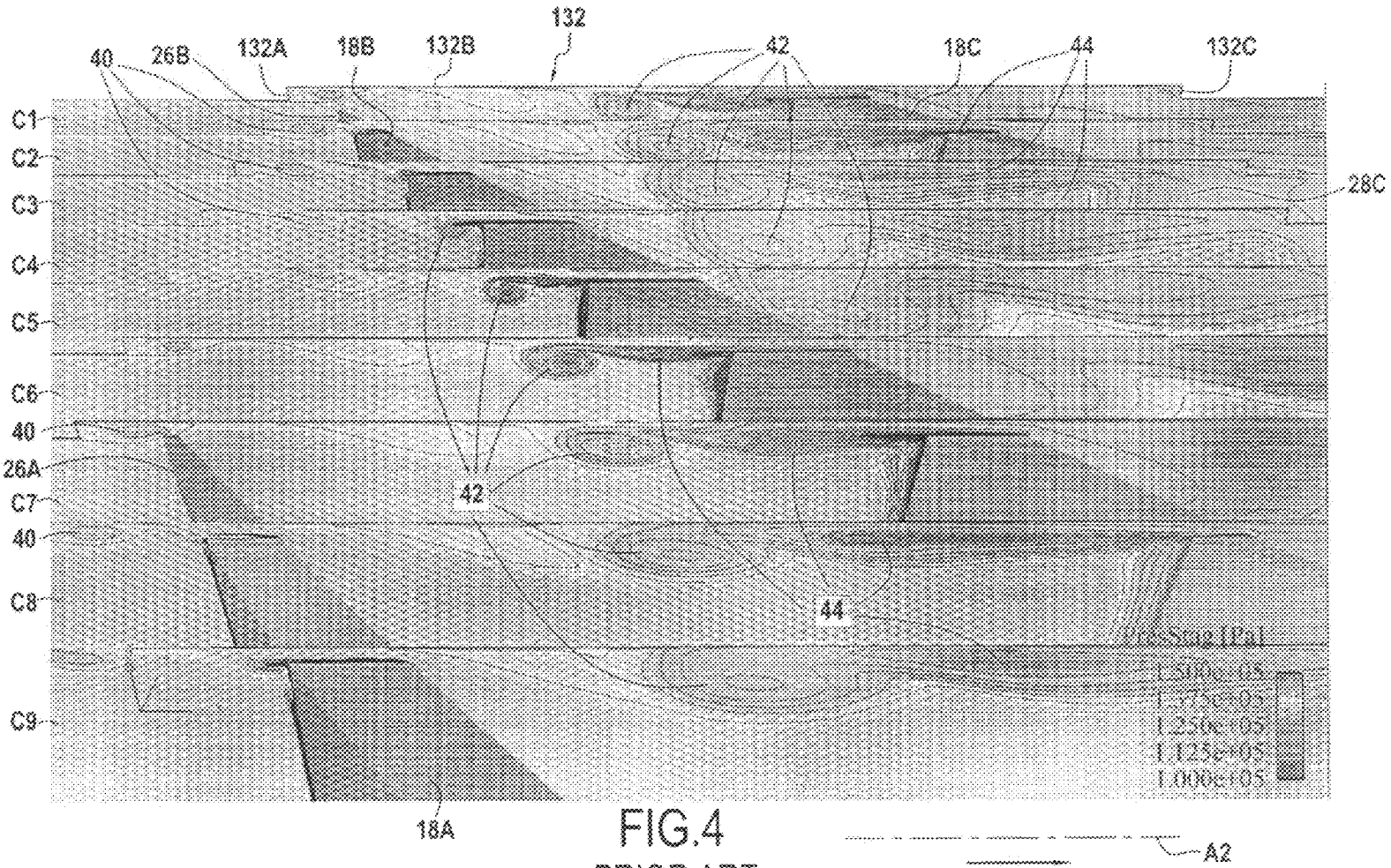
FIG.4 PRIOR ART
FIGS. 4 and 5 are comparative diagrams showing the pressure fields respectively in a compressor with a trench of the prior art, and with a trench of the invention.
Figure 5:
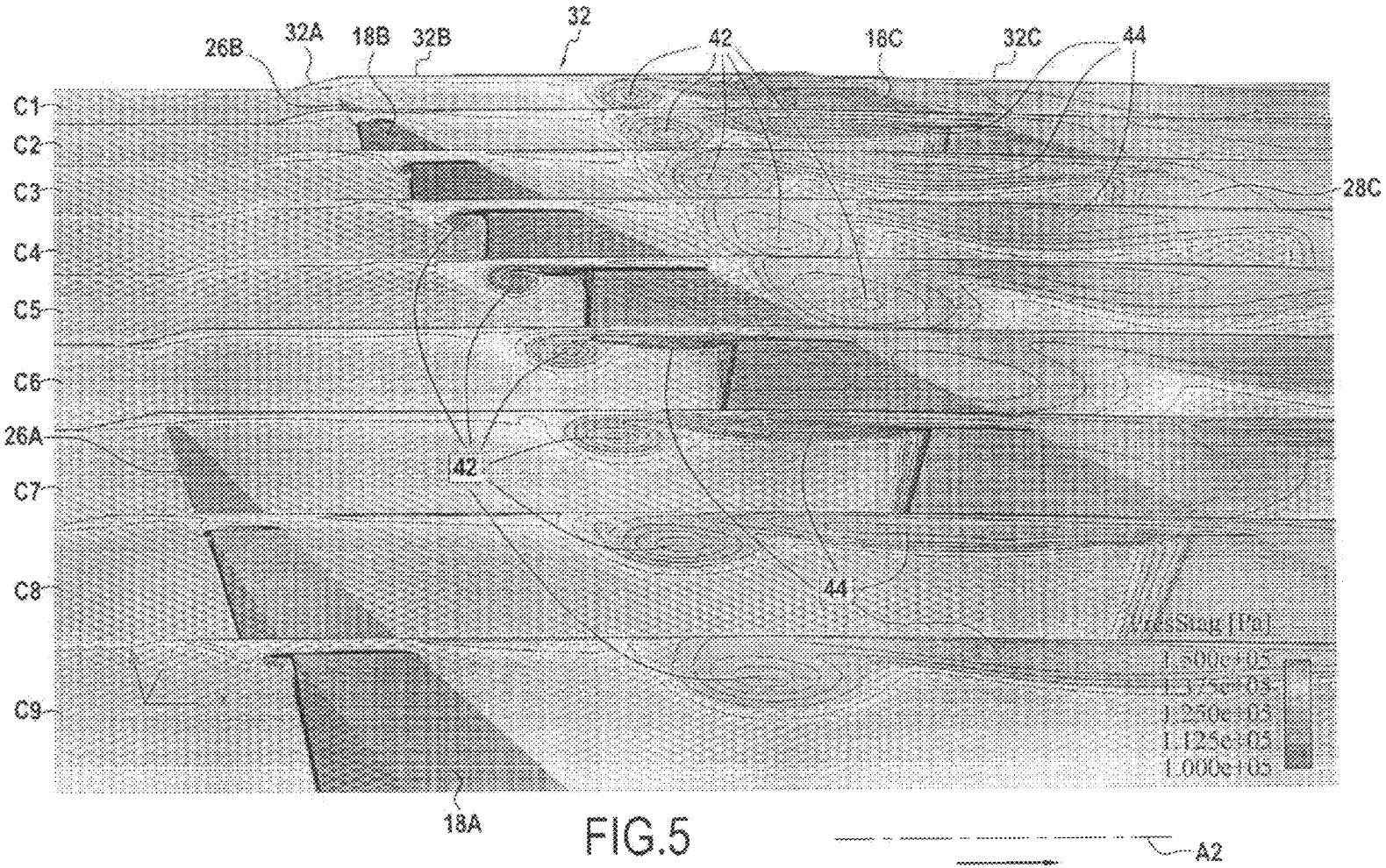

FIGS. 4 and 5 show comparative results obtained by three-dimensional (3D) digital simulations performed on the basis of solving Navier-Stokes equations.

FIG. 4 shows the result of simulating flow in a compressor having a trench of known shape, and FIG. 5 shows the result in a compressor of the invention.

The general direction A2 of the axis A of the compressor is shown in FIGS. 4 and 5. The general direction in which fluid passes through the compressor is also shown by means of an arrow.

The compressor shown in part in FIG. 4 has a trench 132 made up of an upstream surface 132A, a middle surface 132B, and a downstream surface 132C. The upstream and downstream surfaces 132A and 132C form clear staircase steps arranged across the flow of fluid through the passage.

The other references that appear in FIGS. 4 and 5 are the same in both of these FIGS. 4 and 5.

In each of these figures there can be seen the tips of three blades 18A, 18B, and 18C.

In addition, each of these FIGS. 4 and 5 presents a set of parallel fragmentary sections C1-C9. Each of the sections C1-C9 shows diagrammatically the flow in a plane. The various section planes are parallel and extend in the direction A2 of the axis of rotation of the rotor wheel 14 and substantially in the radial direction of the blades 18A-18C.

Each section C1-C9 shows isobar lines in the fluid flow. These lines thus reveal in particular the vortices that form in the flow.

The left-hand portions of FIGS. 4 and 5 begin by showing the first effect of the invention in the vicinity of the leading edges (26A, 26B) of the blades (18A, 18B). FIG. 4 shows the presence of a vortex 40 that is formed immediately downstream from the upstream surface. In the invention (FIG. 5), this vortex 40 is practically eliminated.

It can thus be seen that the shape of the trench 32 serves to reduce the formation of vortices at the upstream surfaces of the trenches. It can be seen that the vortex 40 that forms at the upstream end in a conventional compressor is practically not formed at all in the compressor of the invention and does not cause the main clearance vortex to grow.

Thereafter, the figures show the existence of a main vortex 42 formed by the leading edge. This vortex appears to be affected little by the modifications made to the trench at the blade tip.

Finally, the figures show a vortex 44 associated more particularly with the shape of the trench over the downstream portion of the blade. Once more, in particular in the sections C8 and C9, and also in the sections C3 and C4, it can be seen that the invention leads to a considerable reduction in the vortex 44 in the vicinity of the blade.

It can thus be seen that the vortex generated in the vicinity of the downstream surface is smaller in the compressor of the invention than in the conventional compressor.

In conclusion, these figures show that the compressor shape described in accordance with the present invention provides an increase in efficiency along the operating line and improves the pumping margin. Rotor losses are reduced starting from 75% of the height of the blades.

The invention claimed is:

1. An axial flow turbine engine compressor comprising:

a casing presenting an inside wall of general shape that defines an aerodynamic reference surface defining a gas-passing passage;

a rotor wheel mounted to rotate relative to the casing in the passage;

the rotor wheel carrying a plurality of radial blades, each having a tip, a leading edge, and a trailing edge;

a circumferential trench being formed in the inside wall of the casing;

a shape of the trench being defined by three substantially conical surfaces, of an upstream surface, a middle surface, and a downstream surface, the surfaces following one after another from upstream to downstream;

the middle surface being substantially parallel to the aerodynamic reference surface;

the downstream surface extending downstream at least as far as the trailing edges of the blades;

the upstream surface being located entirely upstream from the leading edges of the blades; and a junction between the middle and downstream surfaces is situated in a range of 30% to 80% of an axial length of the blades starting from the leading edge.

2. A compressor according to claim 1, wherein the upstream surface is entirely located upstream from the leading edges of the blades in a range of 5% to 25% of an inter-blade pitch between the tips of two consecutive blades in the circumferential direction.

3. A compressor according to claim 1, wherein the downstream surface extends downstream from the trailing edges of the blades in a range of 5% to 25% of an inter-blade pitch between tips of two consecutive blades in the circumferential direction.

4. A compressor according to claim 1, wherein, in longitudinal section, the downstream surface forms an angle of less than 15° with the aerodynamic reference surface.

5. A compressor according to claim 1, wherein, in longitudinal section, the upstream surface forms an angle of less than 90° with the aerodynamic reference surface.

6. A compressor according to claim 1, wherein the blades extend inside or as far as the aerodynamic reference surface without penetrating into an inside of the trench.

7. A compressor according to claim 1, wherein a substantially constant radial clearance extends between the tips of the blades and the trench.

8. A turbo engine including at least one compressor according to claim 1.

9. A turbo engine including at least one compressor according to claim 2.

10. A turbo engine including at least one compressor according to claim 3.

11. A turbo engine including at least one compressor according to claim 4.

12. A turbo engine including at least one compressor according to claim 5.

13. A compressor according to claim 2, wherein the upstream surface is entirely located upstream from the leading edges of the blades in a range of 7% to 20% of an inter-blade pitch between the tips of two consecutive blades in the circumferential direction.

14. A compressor according to claim 3, wherein the downstream surface extends downstream from the trailing edges of the blades in a range of 7% to 20% of an inter-blade pitch between tips of two consecutive blades in the circumferential direction.

15. A compressor according to claim 4, wherein, in longitudinal section, the downstream surface forms an angle of less than 5° with the aerodynamic reference surface.

16. A compressor according to claim 5, wherein, in longitudinal section, the upstream surface forms an angle of less than 30° with the aerodynamic reference surface.

* * * * *